US006918215B2

(12) United States Patent
Smith

(10) Patent No.: US 6,918,215 B2
(45) Date of Patent: Jul. 19, 2005

(54) FREE FLOATING SUB-FLOOR PANEL

(75) Inventor: Robert K. Smith, Ancaster (CA)

(73) Assignee: Longlac Wood Industries Inc., Mississauga (CA)

( * ) Notice: Subject to any disclaimer, the term of this patent is extended or adjusted under 35 U.S.C. 154(b) by 0 days.

(21) Appl. No.: 09/809,307

(22) Filed: Mar. 16, 2001

(65) Prior Publication Data

US 2002/0139074 A1 Oct. 3, 2002

(51) Int. Cl.[7] ..... E04F 11/16

(52) U.S. Cl. ..... 52/177; 52/403.1; 52/302.4; 52/480; 52/592.4; 52/590.3

(58) Field of Search ..... 52/480, 586.1, 52/302.1, 302.3, 302.4, 177, 667, 403.1, 404.1, 592.1, 392, 592.4, 590.3

(56) References Cited

U.S. PATENT DOCUMENTS

| | | | | | |
|---|---|---|---|---|---|
| 3,388,516 | A | * | 6/1968 | Thielen | 52/393 |
| 3,440,787 | A | | 4/1969 | Bataille | 52/390 |
| 3,604,173 | A | * | 9/1971 | Dahlborg | 52/508 |
| 3,902,293 | A | * | 9/1975 | Witt et al. | 52/392 |
| 4,052,832 | A | | 10/1977 | Jungers et al. | 52/496 |
| 4,287,693 | A | * | 9/1981 | Collette | 52/177 |
| 4,637,184 | A | * | 1/1987 | Radtke et al. | 52/220 |
| 4,860,510 | A | * | 8/1989 | Kotler | 52/177 |
| 4,879,857 | A | | 11/1989 | Peterson et al. | 52/403 |
| 4,888,927 | A | | 12/1989 | Yoshimi et al. | |
| 4,890,434 | A | * | 1/1990 | Niese | 52/393 |
| 4,910,936 | A | * | 3/1990 | Abendroth et al. | 52/403 |
| 4,930,286 | A | * | 6/1990 | Kotler | 52/177 |
| 4,945,697 | A | | 8/1990 | Ott et al. | 52/396 |
| 5,182,891 | A | * | 2/1993 | Slocum | 52/480 |
| 5,303,526 | A | * | 4/1994 | Niese | 52/393 |
| 5,433,052 | A | * | 7/1995 | Niese | 52/403.1 |
| 5,465,546 | A | | 11/1995 | Buse | 52/480 |
| 5,572,842 | A | * | 11/1996 | Stief et al. | 52/403.1 |
| 5,619,832 | A | * | 4/1997 | Myrvold | 52/403.1 |
| 5,661,937 | A | * | 9/1997 | Doppler et al. | 52/410 |
| 5,666,772 | A | * | 9/1997 | Betty | 52/177 |
| 5,827,592 | A | * | 10/1998 | Van Gulik et al. | 428/44 |
| 5,906,082 | A | | 5/1999 | Counihan | 52/403.1 |
| 5,950,378 | A | | 9/1999 | Council et al. | 52/177 |
| 5,968,630 | A | * | 10/1999 | Foster | 428/77 |
| 5,976,689 | A | * | 11/1999 | Witt et al. | 428/339 |
| 6,029,416 | A | | 2/2000 | Andersson | 52/592.1 |
| 6,539,681 | B1 | * | 4/2003 | Siegmund | 52/403.1 |

FOREIGN PATENT DOCUMENTS

| | | | |
|---|---|---|---|
| CA | 713745 | 7/1965 | |
| CA | 1186470 | 3/1982 | |
| CA | 1279968 | 2/1991 | 20/17 |
| DE | 25 08 628 | 2/1975 | |
| DE | 25 08 628 | 9/1976 | E04F/15/10 |
| DE | 197 21 736 A1 | 5/1997 | |
| DE | 197 21 736 A1 | 11/1998 | E04F/15/18 |

(Continued)

OTHER PUBLICATIONS

Brochure, *System Platon F2*, Isola, CA02315462, Aug. 14, 2002.

(Continued)

*Primary Examiner*—Carl Friedman
*Assistant Examiner*—Yvonne M. Horton
(74) *Attorney, Agent, or Firm*—Gowling Lafleur Henderson LLP; Peter Milne

(57) ABSTRACT

A floor panel is provided for use in a sub-floor application. The floor panel has an upper member and a lower member. The upper member is made from a sheet floor material and the lower member is made from a waterproof sheet material. The lower member has a series of projections extending away from the floor panel and located adjacent to an underlying surface when the panel is in use. The projections allow moisture to drain between the floor panels and the underlying surface and also permit air circulation.

79 Claims, 5 Drawing Sheets

FOREIGN PATENT DOCUMENTS

| | | | |
|---|---|---|---|
| EP | 0 875 637 A2 | 11/1998 | ..... E04D/11/00 |
| JP | 10219897 | 8/1998 | ..... E04B/5/02 |
| JP | 2000145103 | 5/2000 | |
| SE | 1122998 | 10/1965 | |
| WO | WO 82/03099 | 9/1982 | |

OTHER PUBLICATIONS

Brochure, *Platon Floor Underlay for Wooden Floors on Concrete*Big 'O'CA02315462 Aug. 14, 2002.

CCMC Evaluation Report, National Research Council Canada, Platon Damproofing Membrane, Jul. 26, 1991 National Evaluation Report, National Evaluation Service, Inc., System Platon Foundation Membrane, Jun. 1, 2001 System Platon Website, searched by platon floor, Mar. 3, 2002.

Brochure, Delta–Flooring, Cosella/Dorken 02/96.

Brochure, Fuktsparren, Fuktsparren, *Det Finns En Losning Pa Gardagens Och Morgondagens Fuktproblem*, Dorken 98.08.

Samlingsbroschyr Och Monteringsanvisning.

Brochure, *Building Products Worth A Second Look*, A Hanley–Wood, Inc. Publication, May/Jun. 1999 Installation Guide, Delta–FI, *Keeping Floors Warm & Dry*, Cosella/Dorken, 04/98.

Brochure Delta–MA, Air–Gap/Drainage Membrane Cosella/Dorken Davison, Brian *Installation Manual & Specification Guide* Delta Membrane Systems Ltd., 1992.

* cited by examiner

FREE FLOATING SUB-FLOOR PANEL

FIELD OF THE INVENTION

The present invention relates to floor panels and more particularly, to free floating sub-floor panels capable of supporting a floor and having a rigid waterproof lower layer that permits moisture drainage and air circulation.

BACKGROUND OF THE INVENTION

A finished floor typically consists of a sub-floor and a flooring surface, supported by the sub-floor. The nature of a sub-floor will vary depending on the flooring surface it needs to support and the environment in which it must function. For example, for linoleum tile or carpet on a main floor of a house, the sub-floor may simply consist of sheets of plywood. For a ceramic tile floor a cement layer will typically also be required.

Basement flooring presents additional challenges, one of which is the possibility of moisture being present and another which is to insulate the floor from what could be a very cold underlying surface of poured concrete. Fixed sub-floors or "non-floating" sub-floors can be used in basement applications. This type of flooring may have an underlying sheet of semi rigid plastic having depending protrusions over which is placed a series of plywood panels. The panels are securely fixed to the underlying floor using concrete bolts. Fixed sub-floors may be rather labour intensive to install and rely on secure and frequent fastening to prevent movement between adjacent flooring sheets.

U.S. Pat. No. 4,945,697 to Ott et al. which teaches a floor tile and floor for direct installation on a support such as a floor or walkway without a sub-floor. This patent teaches a floor system that uses floor tiles comprised of two layers, an upper layer made of ceramic material and a lower layer made from resilient material with anti-skid characteristics. The two layers are secured together to form a floor tile. The lower layer includes drainage channels on the underside, that allow the passage of water underneath the floor tiles. When used outside, the tiles are spaced apart with gaps between adjacent tiles to allow vertical movement between the tiles. When the floor tiles are used indoors, the gap between adjacent tiles is filled with a flexible material that allows vertical shifting of the tiles. These tiles will not provide a rigid sub-floor layer that would be capable of use in a sub-floor application for supporting a further rigid floor layer on top of the tiles, since any vertical motion between adjacent tiles would cause the further floor layer to crack.

Another example of a non sub-floor application is U.S. Pat. No. 5,950,378 to Council et al. This patent describes a composite modular floor tile for use in athletic playing surfaces such as basketball courts and tennis courts. The floor tile has a top and a bottom member with support nodes extending from the bottom member which provide an air circulation space underneath the floor tiles. The bottom member is made from a resilient impact absorbing material that would not provide a rigid supporting layer and therefore would not be suitable in a sub-floor application.

Accordingly, it is an object of the present invention to provide a sub-floor panel capable of supporting a floor that will allow moisture drainage and air circulation between the tiles and the underlying surface.

SUMMARY OF THE INVENTION

A floor panel is provided that is capable of supporting a floor surface and provides under-floor drainage. The floor panel has an upper member and a lower member attached to the upper member. The upper member is made from a sheet flooring material and the lower member is made from a waterproof sheet material. The lower member has a plurality of projections extending away from the panel to support the floor panel above an underlying surface and to permit moisture to drain between the floor panels and the underlying surface.

BRIEF DESCRIPTION OF THE DRAWINGS

Preferred embodiments of the invention are described below with reference to the accompanying drawings, in which.

BRIEF DESCRIPTION OF THE PREFERRED EMBODIMENTS

Figure 1:
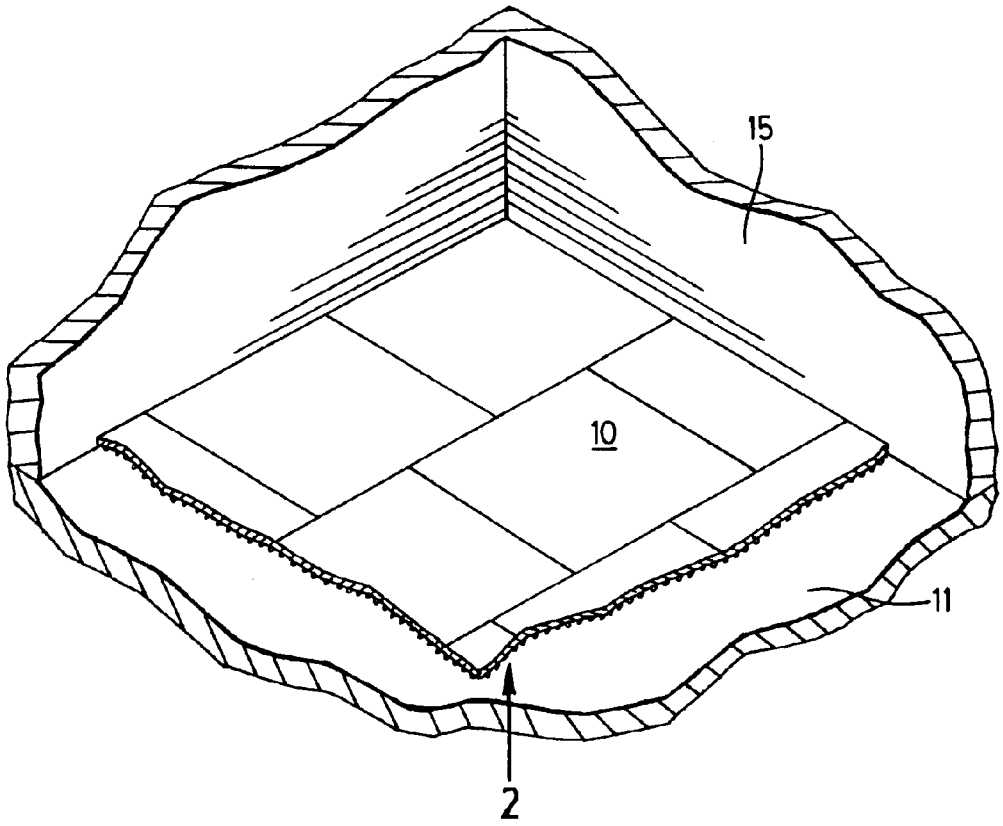
FIG. 1 is a scrap perspective schematic view of the panels of the invention.
Figure 2:
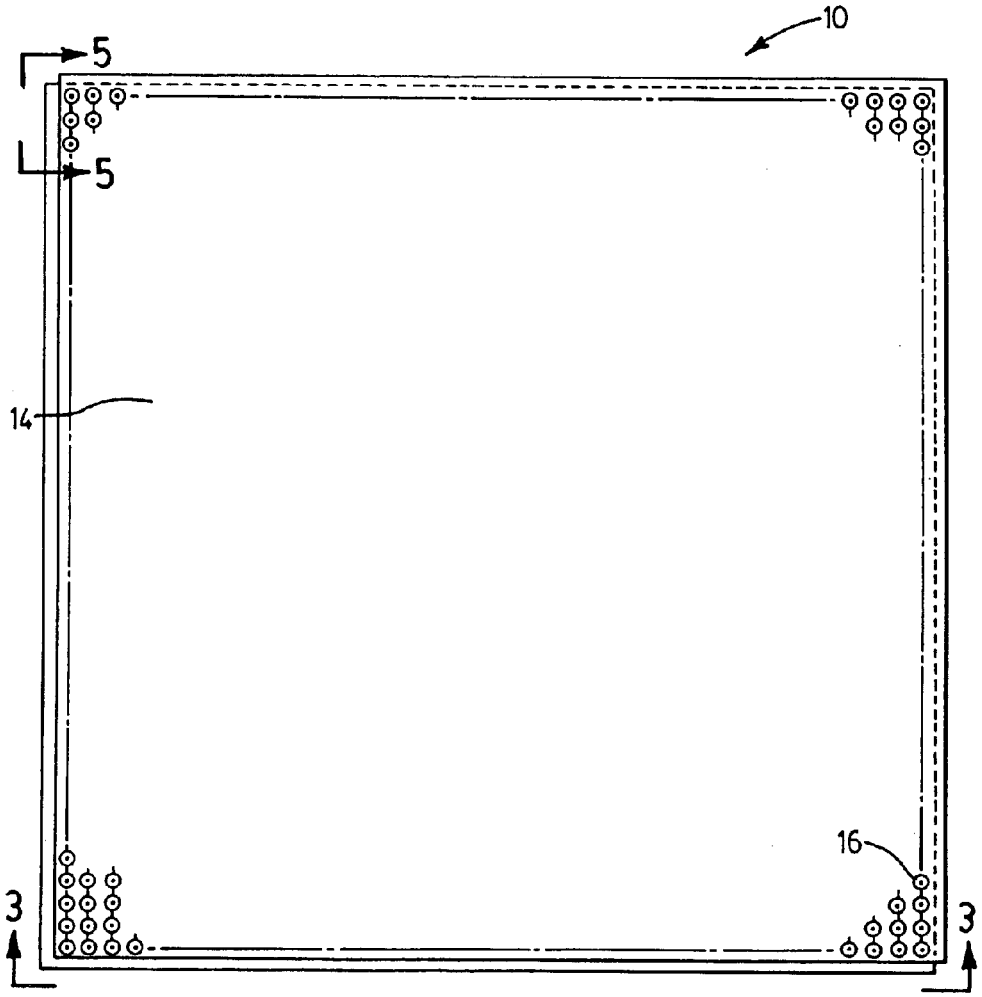
FIG. 2 is an underside plan of a floor panel according to a preferred embodiment of the invention taken in the direction of Arrow 2 of FIG. 1, and showing the lower member with a series of projections and a tongue projecting out from two of the panel edges.
Figure 3:
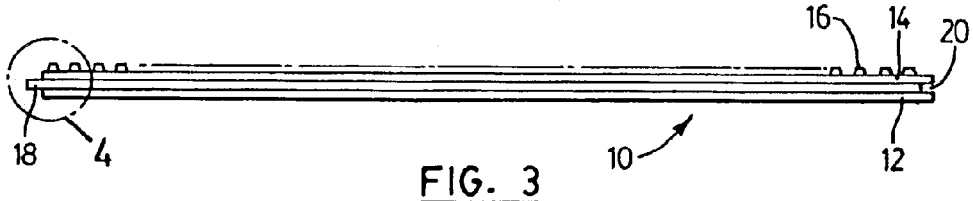
FIG. 3 is a side elevation of the floor panel of FIG. 2 taken in the direction of the stations 3—3.

Reference is first made to FIGS. 1 to 3 to describe a preferred embodiment of the floor panel, designated generally by the numeral 10. The floor panel 10 includes an upper member 12 of sheet flooring material and a lower member 14. The lower member 14 is attached to the upper member 12. The lower member 14 may be of polyethylene or other suitable waterproof sheet material and includes a plurality of projections 16 which rest on an underlying surface 11 to support the floor panel 10 on the underlying surface 11 and allow moisture to drain between them and to permit air circulation between the floor panel 10 and the underlying surface 11 when the floor panel 10 is installed. FIG. 1 illustrates a series of floor panels 10 adjacent and interlocking one another.

In a preferred embodiment, the floor panel 10 is attached to the adjacent floor panel 10 using a tongue 18 and a groove 20 arrangement, which will be described later.

The floor panel 10 will now be described in more detail. As seen in FIG. 2, the floor panel 10 may be square, and is preferably manufactured as a 4' by 4' panel, although other sizes may also be manufactured. The upper member 12 is attached to the lower member 14 using an adhesive 22. The adhesive 22 must be compatible with the upper member 12 and the lower member 14. In a preferred embodiment where the lower member 14 is of polyethylene, the adhesive 22 is Fastbond 2000-NF™ manufactured by 3M Canada Company.

In a preferred embodiment, the upper member 12 is made from random wafer board, such as manufactured and sold under the name Waferweld™ by Longlac Wood Industries Inc., as opposed to oriented strand board ("OSB"). Random wafer board is manufactured from wood chips that have a random orientation, as opposed to oriented strand board ("OSB") in which wood strands are oriented to lay in a perpendicular fashion with the majority of strands oriented to lay with the longitudinal direction of the board. The random orientation of the chips allows the random wafer board to expand evenly in all directions as opposed to longitudinal expansion tendencies characteristic of OSB which makes random wafer board less prone to buckling in this flooring application. The lower member 14 may be made from System Platon™ manufactured by Armtec Limited.

Figure 4:
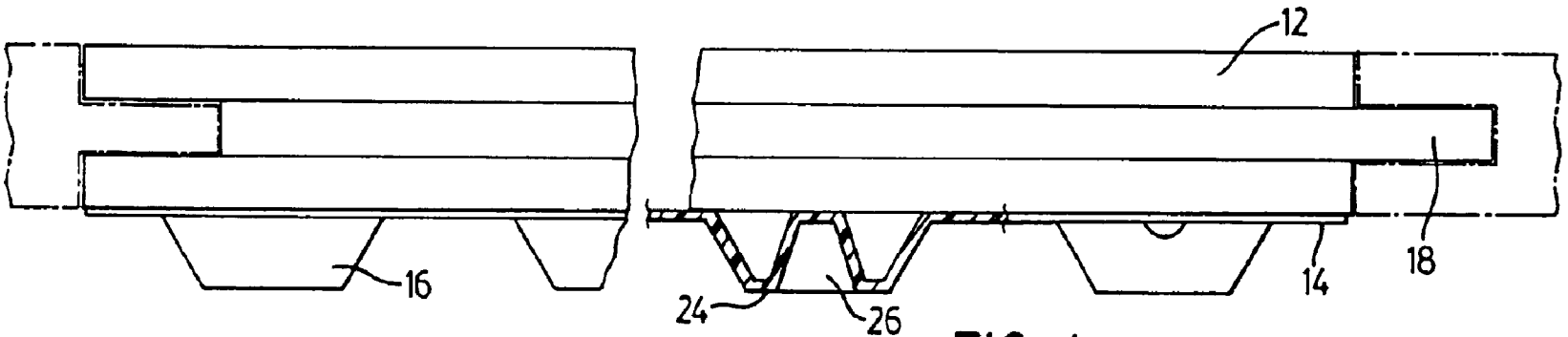
FIG. 4 is an enlarged scrap elevation of the floor panel of FIG. 3 indicated in the circle 4, but inverted from FIG. 3 to show the panel in its installed orientation, with one of the projections shown in sectional view and adjacent floor panels shown in chain dot outline.

Turning now to FIG. 4, the projections 16 extend away from the lower member 14 in the opposite direction to the upper member 12. The projections 16 are frustoconical shaped with a bottom surface 24 and a cavity 26 extending from the bottom surface 24 towards the upper member 12. Preferably the projections 16 are aligned in rows and columns to enable the floor panels 10 to be cut between the projections 16 without leaving any half-cut projections 16. When the floor panel 10 is installed, the bottom surface 24 of the projections 16 is located adjacent the underlying surface 11. In some applications further levelling of the floor panels 10 may be required if the underlying surface 11 is uneven. This can be achieved by stacking additional layers of the lower member 14 under the lower member 14 on the floor panel 10 in the areas where raising is required. The additional layers of the lower member 14 can be sized to fit the area that requires further levelling.

In order to connect adjacent floor panels, the panel sides may be configured in a tongue and groove arrangement. The upper member 12 of each floor panel 10 has a tongue 18 protruding from two adjacent sides and a groove 20 extending into each of the remaining sides. The groove 20 is sized and operable to receive the tongue 18 to interconnect adjacent floor panels. The tongue 18 is formed during manufacturing of the floor panel 10 by shaping the upper member 12.

Figure 5:
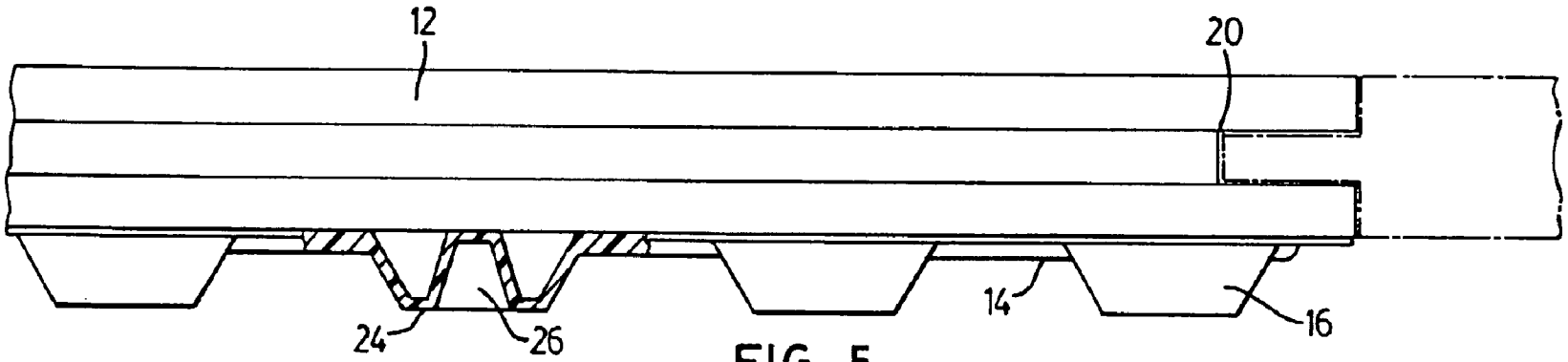
FIG. 5 is a similar view to FIG. 4, but showing the area in the direction of stations 5—5, and an adjacent floor panel shown in chain dot outline.
Figure 6:
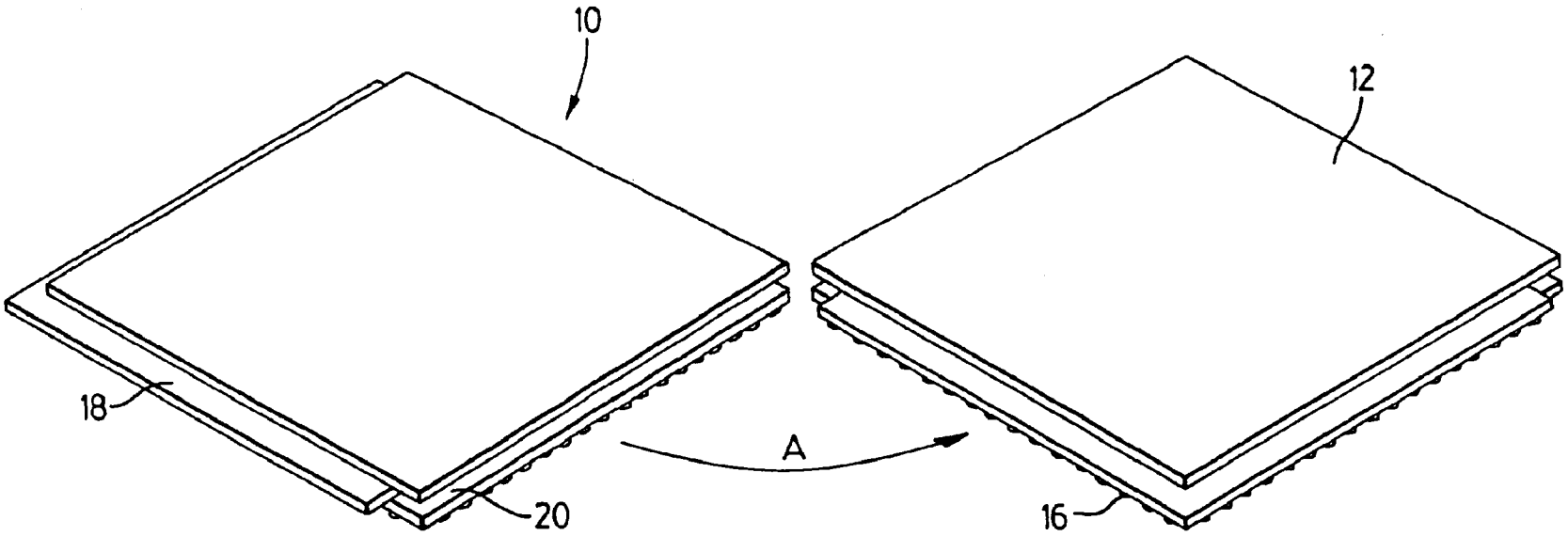
FIG. 6 is a clam-shell exploded perspective view of two of the floor panels to show the tongue and groove relationship.

In use, a series of floor panels are interlocked and located on an underlying surface 11, shown in FIG. 1, and abutting walls 15. In the preferred embodiment, adjacent floor panels are interconnected using a tongue and groove arrangement as shown in FIGS. 4 to 6. Each floor panel 10 is placed with the projections 16 adjacent the underlying surface. In order to connect each floor panel 10 to an adjacent floor panel 10, the tongue 18 of the floor panel 10 is inserted into the groove 20 located on the adjacent floor panel 10, as indicated by arrow A shown in FIG. 6.

Although not illustrated, it will be appreciated that when the floor panels 10 have been installed over the underlying surface 11, an additional flooring surface can be laid on top of the floor 5 panels 10. Excess moisture can flow between the projections 16 and air can circulate between the floor panels 10 and the underlying surface 11.

Figure 7:
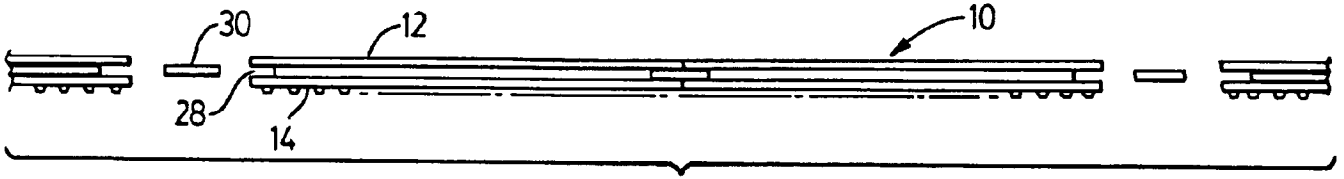
FIG. 7 is a side elevation similar to FIG. 3 of an alternative embodiment showing the panels with a key and groove arrangement.
Figure 8:
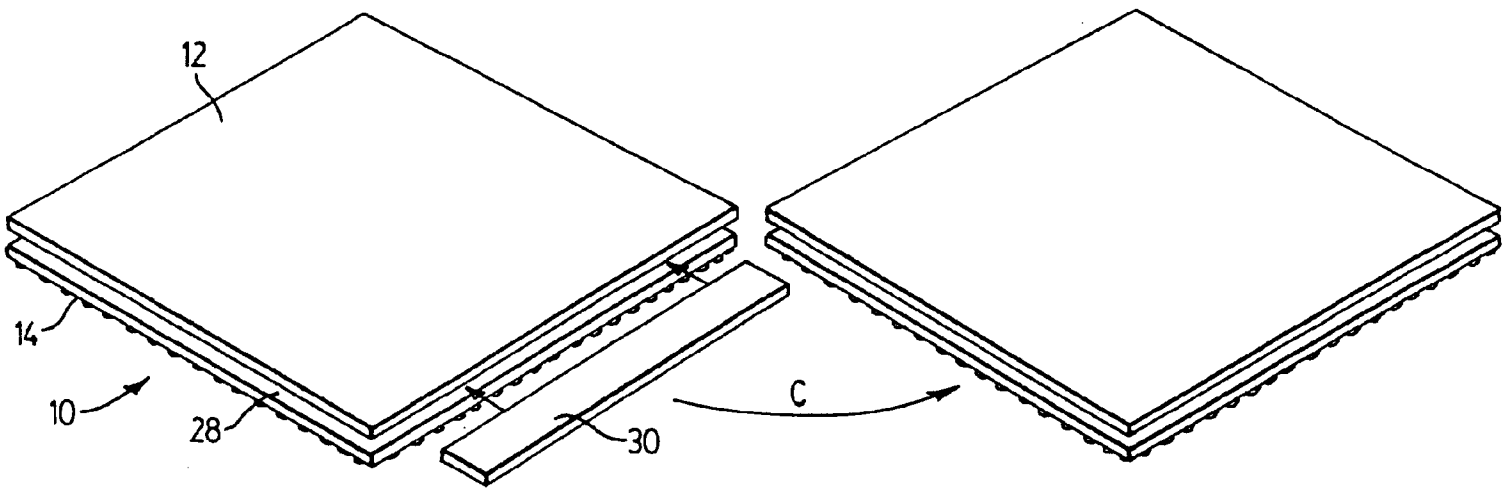
FIG. 8 is a clam-shell exploded perspective view of two floor panels of the embodiment of FIG. 7 to show a loose key in its relationship.

Turning now to FIGS. 7 and 8, an alternative interlocking arrangement to connect adjacent floor panels is shown. Each floor panel 10 has a groove 28 similar to the groove 20 described above, but running along all of the edges of the floor panel 10. To interlock adjacent floor panels, a key 30 which is sized to fit within the groove 28 is utilized. The groove 28 is operable to receive approximately half the width of the key 30. When the key 30 has been inserted into the groove 28 of the floor panel 10, an adjacent floor panel 10 can be attached to the protruding edge, the remaining half of the key 30.

To install the floor panels 10 that use a key and groove arrangement, the key 30 must first be inserted into the second groove 28 in the direction shown by arrow C in FIG. 8. Once the key 30 is installed the floor panel 10 is inserted into the second groove 28 on an adjacent floor panel 10, in the direction shown by arrow C in FIG. 8. Similarly, adjacent panels are interconnected until the required subfloor coverage is achieved.

The preferred embodiment can be modified in many ways. For instance, the lower member 14 can be made from any suitable waterproof sheet material. The projections 16 can be located in a random pattern on the lower member 14. The interlocking structure of the tongue and groove arrangement can be any interlocking combination that will prevent significant vertical shifting between adjacent panels. Other adhesives may be used that are capable of securely bonding the upper member to the lower member.

The floor panel described as exemplary of the invention can be modified as required in such fortification within the scope of the description and invention and claims.

| PARTS LIST | |
|---|---|
| 10 | floor panel |
| 11 | underlying surface |
| 12 | upper member |
| 14 | lower member |
| 15 | walls |
| 16 | projections |
| 18 | tongue |
| 20 | groove |
| 22 | adhesive |
| 24 | bottom surface |
| 26 | cavity |
| 28 | groove |
| 30 | key |

I claim:

1. A flooring panel which provides undertfloor drainage, the flooring panel comprising:

an upper member comprising rigid sheet flooring material;

a substantially rigid lower member attached to the upper member, the lower member comprising a continuous, water impervious sheet material having a plurality of projections in the form of knobs extending away from the upper member to support the upper member above an underlying surface, to protect the upper member from water and to permit free drainage of water about the projections and between the flooring panel and the underlying surface; and at least one part of an interlocking assembly for interlocking an edge of the panel with an adjacent edge of another panel so as to prevent relative vertical movement therebetween, wherein the interlocking assembly is configured to interlock the edges of the panels via lateral movement of one panel with respect to the other.

2. A flooring panel according to claim 1, wherein the upper member is made from random wafer board.

3. A flooring panel according to claim 1, wherein the lower member is made from a plastics material.

4. A flooring panel according to claim 3, wherein the plastics material is polyethylene.

5. A flooring panel according to claim 2, wherein the lower member is made from a plastics material.

6. A flooring panel according to claim 5, wherein the plastics material is polyethylene.

7. A flooring panel according to claim 1, wherein the lower member is adhesively attached to the upper member.

8. A flooring panel according to claim 6, wherein the lower member is adhesively attached to the upper member.

9. A flooring panel according to claim 1, wherein the interlocking assembly comprises at least one tongue and at least one groove.

10. A flooring panel according to claim 1, wherein the interlocking assembly comprises at least one key and at least one groove.

11. A plurality of flooring panels, comprising:

a first flooring panel and a second flooring panel, wherein each of the first and second flooring panels is a flooring panel according to claim 1, and wherein an edge of the first panel and an edge of the second panel are configured to be connected together so as to prevent relative vertical movement therebetween.

12. A flooring panel according to claim 1, wherein the rigid sheet flooring material comprises wood.

13. A flooring panel according to claim 1, wherein the panel has a square shape.

14. A flooring panel according to claim 13, wherein a size of the panel is four feet by four feet.

15. A flooring panel according to claim 13, wherein the lower member has a square shape.

16. A method of installing flooring panels, comprising:

positioning an entire first flooring panel and an entire second flooring panel onto an underlying surface, wherein each of the first and second flooring panels is a flooring panel according to claim 1; and connecting the first and second flooring panels together.

17. A method according to claim 16, wherein the positioning comprises moving the entire first flooring panel onto the underlying surface and moving the entire second flooring panel onto the underlying surface.

18. A method according to claim 16, wherein the connecting comprises moving the entire first flooring panel with respect to the entire second flooring panel.

19. A flooring panel which provides underfloor drainage, the flooring panel comprising:

an upper member comprising rigid sheet flooring material;

a substantially rigid lower member attached to the upper member, the lower member comprising a continuous, water impervious sheet material having a plurality of projections in the form of knobs extending away from the upper member to support the upper member above an underlying surface, to protect the upper member from water and to permit free drainage of water about the projections and between the flooring panel and the underlying surface; and a tongue located on two adjacent edges of said upper member and a groove located on two adjacent edges of said upper member for connecting the panel to an adjacent panel having at least one corresponding tongue and at least one corresponding groove to prevent relative vertical movement therebetween.

20. A flooring panel according to claim 19, wherein the rigid sheet flooring material comprises wood.

21. A flooring panel which provides underfloor drainage, the flooring panel comprising:

an upper member comprising random wafer board;

a substantially rigid lower member attached to the upper member, the lower member comprising a continuous, water impervious sheet material having a plurality of projections in the form of knobs extending away from the upper member to support the upper member above an underlying surface, to protect the upper member from water and to permit free drainage of water about the projections and between the flooring panel and the underlying surface; and said upper member having a tongue located on two adjacent edges and a groove located on two adjacent edges for connecting the panel to an adjacent panel comprising two corresponding tongues and two corresponding grooves to prevent relative vertical movement therebetween.

22. A plurality of flooring panels, comprising:

a first flooring panel comprising a first upper member comprising rigid sheet flooring material, a substantially rigid first lower member attached to the first upper member, the first lower member comprising a continuous, water impervious sheet material having a plurality of projections in the form of knobs extending away from the first upper member to support the first upper member above an underlying surface, to protect the first upper member from water and to permit free drainage of water about the projections and between the first flooring panel and the underlying surface; and a second flooring panel comprising a second upper member comprising rigid sheet flooring material, a substantially rigid second lower member attached to the second upper member, the second lower member comprising a continuous, water impervious sheet material having a plurality of projections in the form of knobs extending away from the second upper member to support the second upper member above the underlying surface, to protect the second upper member from water and to permit free drainage of water about the projections and between the second flooring panel and the underiying surface, wherein an edge of the first panel and an edge of the second panel are configured to be connected together so as to prevent relative vertical movement therebetween.

23. A plurality of flooring panels according to claim 22, wherein the first and second upper members are made from random wafer board.

24. A plurality of flooring panels according to claim 22, wherein the first and second lower members are made from plastics material.

25. A plurality of flooring panels according to claim 22, wherein the edge of the first panel comprises a groove and the edge of the second panel comprises a tongue.

26. A plurality of flooring panels according to claim 25, wherein the groove has an opening facing in a lateral direction.

27. A plurality of flooring panels according to claim 25, wherein the first upper member comprises the groove and the second upper member comprises the tongue.

28. A plurality of flooring panels according to claim 22, wherein the edge of the first panel comprises a groove and the edge of the second panel comprises a groove.

29. A plurality of flooring panels according to claim 28, further comprising at least one key.

30. A plurality of flooring panels according to claim 28, wherein the first upper member comprises the groove of the first panel and the second upper member comprises the groove of the second panel.

31. A plurality of flooring panels according to claim 28, wherein each of the groove of the first panel and the groove of the second panel has an opening extending in a lateral direction.

32. A plurality of flooring panels according to claim 22, wherein the rigid sheet flooring material of the first upper member comprises wood and the rigid sheet flooring material of the second upper member comprises wood.

33. A plurality of flooring panels according to claim 22, wherein the first lower member is adhesively attached to the first upper member, and wherein the second lower member is adhesively attached to the second upper member.

34. A plurality of flooring panels according to claim 22, wherein each of the first and second panels has a square shape.

35. A plurality of flooring panels according to claime 34, wherein a size of each of the first and second panels is four feet by four feet.

36. A plurality of flooring panels according to claim 35, wherein each of the first lower member and the second lower member has a square shape.

37. A method of installing a plurality of flooring panels according to claim 22, the method comprising:

positioning the entire first flooring panel and the entire second flooring panel onto an underlying surface; and connecting the first and second flooring panels together.

38. A method according to claim 37, wherein the positioning comprises moving the entire first flooring panel onto the underlying surface and moving the entire second flooring panel onto the underlying surface.

39. A method according to claim 37, wherein the connecting comprises moving the entire first flooring panel with respect to the entire second flooring panel.

40. A flooring panel which provides underfloor drainage, the flooring panel comprising:

an upper member comprising rigid sheet flooring material; and a substantially rigid lower member attached to the upper member, the lower member comprising a continuous, water impervious sheet material having a plurality of projections in the form of knobs extending away from the upper member to support the upper member above an underlying surface, to protect the upper member from water and to permit free drainage of water about the projections and between the flooring panel and the underlying surface, wherein an edge of the panel comprises a groove configured to connect an edge of the panel to an edge of another panel so as to prevent relative vertical movement therebetweeri, and wherein the groove has an opening facing in a lateral direction.

41. A flooring panel according to claim 40, wherein the upper member comprises the groove.

42. A flooring panel according to claim 40, wherein the rigid sheet flooring material comprises wood.

43. A flooring panel which provides underfloor drainage, the flooring panel comprising:

an upper member comprising rigid sheet flooring material;

a substantially rigid lower member adhesively attached to the upper member, the lower member comprising a continuous, water impervious sheet material having a plurality of projections in the form of knobs extending away from the upper member to support the upper member above an underlying surface, to protect the upper member from water and to permit free drainage of water about the prolections and between the flooring panel and the underlying surface, wherein the lower member comprises plastics material; and a tongue located on two adjacent edges of said upper member and a groove located on two adjacent edges of said upper member for connecting the panel to an adjacent panel having at least one corresponding tongue and at least one corresponding groove.

44. A flooring panel according to claim 43, wherein the rigid sheet flooring material comprises wood.

45. A flooring panel which provides underfloor drainage, the flooring panel comprising:

an upper member comprising rigid sheet flooring material;

a substantially rigid lower member attached to the upper member, the lower member comprising a continuous, water impervious sheet material having a plurality of projections extending away from the upper member to support the upper member above an underlying surface, to protect the upper member from water and to permit free drainage of water about the projections and between the flooring panel and the underlying surface; and at least one part of an interlocking assembly for interlocking an edge of the panel with an adjacent edge of another panel so as to prevent relative vertical movement therebetween, wherein the interlocking assembly is configured to interlock the edges of the panels via lateral movement of one panel with respect to the other.

46. A flooring panel according to claim 45, wherein the lower member is made from a plastics material.

47. A flooring panel according to claim 45, wherein the lower member is adhesively attached to the upper member.

48. A flooring panel according to claim 45, wherein the interlocking assembly comprises at least one tongue and at least one groove.

49. A flooring panel according to claim 45, wherein the interlocking assembly comprises at least one key and at least one groove.

50. A flooring panel according to claim 45, wherein the rigid sheet flooring material comprises wood.

51. A flooring panel according to claim 45, wherein the panel has a square shape.

52. A flooring panel according to claim 51, wherein a size of the panel is four feet by four feet.

53. A flooring panel according to claim 51, wherein the lower member has a square shape.

54. A method of installing flooring panels, comprising:

positioning an entire first flooring panel and an entire second flooring panel onto an underlying surface, wherein each of the first and second flooring panels is a flooring panel according to claim 45; and connecting the first and second flooring panels together.

55. A method according to claim 54, wherein the positioning comprises moving the entire first flooring panel onto the underlying surface and moving the entire second flooring panel onto the underlying surface.

56. A method according to claim 54, wherein the connecting comprises moving the entire first flooring panel with respect to the entire second flooring panel.

57. A flooring panel which provides underfloor drainage, the flooring panel comprising:

an upper member comprising rigid sheet flooring material;

a substantially rigid lower member attached to the upper member, the lower member comprising a continuous, water impervious sheet material having a plurality of projections extending away from the upper member to support the upper member above an underlying surface, to protect the upper member from water and to permit free drainage of water about the projections and between the flooring panel and the underlying surface; and a tongue located on two adjacent edges of said upper member and a groove located on two adjacent edges of said upper member for connecting the panel to an adjacent panel having at least one corresponding tongue and at least one corresponding groove to prevent relative vertical movement therebetween.

58. A flooring panel according to claim 57, wherein the lower member is adhesively attached to the upper member and the lower member comprises plastics material.

59. A flooring panel according to claim 58, wherein the rigid sheet flooring material comprises wood.

60. A plurality of flooring panels, comprising:

a first flooring panel comprising a first upper member comprising rigid sheet flooring material, a substantially rigid first lower member attached to the first upper member, the first lower member comprising a continuous, water impervious sheet material having a plurality of projections extending away from the first upper member to support the first upper member above an underlying surface, to protect the first upper member from water and to permit free drainage of water about the projections and between the first flooring panel and the underlying surface; and a second flooring panel comprising a second upper member comprising rigid sheet flooring material, a substantially rigid second lower member attached to the second upper member, the second lower member comprising a continuous, water impervious sheet material having a plurality of projections extending away from the second upper member to support the second upper member above the underlying surface, to protect the second upper member from water and to permit free drainage of water about the projections and between the second flooring panel and the underlying surface, wherein an edge of the first panel and an edge of the second panel are configured to be connected together so as to prevent relative vertical movement therebetween.

61. A plurality of flooring panels according to claim 60, wherein the first and second lower members are made from plastics material.

62. A plurality of flooring panels according to claim 60, wherein the edge of the first panel comprises a groove and the edge of the second panel comprises a tongue.

63. A plurality of flooring panels according to claim 62, wherein the groove has an opening facing in a lateral direction.

64. A plurality of flooring panels according to claim 62, wherein the first upper member comprises the groove and the second upper member comprises the tongue.

65. A plurality of flooring panels according to claim 60, wherein the edge of the first panel comprises a groove and the edge of the second panel comprises a groove.

66. A plurality of flooring panels according to claim 65, further comprising at least one key.

67. A plurality of flooring panels according to claim 65, wherein the first upper member comprises the groove of the first panel and the second upper member comprises the groove of the second panel.

68. A plurality of flooring panels according to claim 65, wherein each of the groove of the first panel and the groove of the second panel has an opening extending in a lateral direction.

69. A plurality of flooring panels according to claim 60, wherein the rigid sheet flooring material of the first upper member comprises wood and the rigid sheet flooring material of the second upper member comprises wood.

70. A plurality of flooring panels according to claim 60, wherein the first lower member is adhesively attached to the first upper member, and wherein the second lower member is adhesively attached to the second upper member.

71. A plurality of flooring panels according to claim 60, wherein each of the first and second panels has a square shape.

72. A plurality of flooring panels according to claim 71, wherein a size of each of the first and second panels is four feet by four feet.

73. A plurality of flooring panels according to claim 71, wherein each of the first lower member and the second lower member has a square shape.

74. A method of installing a plurality of flooring panels according to claim 60, method comprising:

positioning the entire first flooring panel and the entire second flooring panel onto an underlying surface; and connecting the first and second flooring panels together.

75. A method according to claim 74, wherein the positioning comprises moving the entire first flooring panel onto the underlying surface and moving the entire second flooring panel onto the underlying surface.

76. A method according to claim 74, wherein the connecting comprises moving the entire first flooring panel with respect to the entire second flooring panel.

77. A flooring panel which provides underfloor drainage, the flooring panel comprising:

an upper member comprising rigid sheet flooring material; and a substantially rigid lower member attached to the upper member, the lower member comprising a continuous, water impervious sheet material having a plurality of projections extending away from the upper member to support the upper member above an underlying surface, to protect the upper member from water and to permit free drainage of water about the projections and between the flooring panel and the underlying surface, wherein an edge of the panel comprises a groove configured to connect an edge of the panel to an edge of another panel so as to prevent relative vertical movement therebetween, and wherein the groove has an opening facing in a lateral direction.

78. A flooring panel according to claim 77, wherein the upper member comprises the groove.

79. A flooring panel according to claim 77, wherein the rigid sheet flooring material comprises wood.

* * * * *